United States Patent [19]

van Heemskerck Veeckens

[11] 4,134,042

[45] Jan. 9, 1979

[54] ELECTRIC DISCHARGE LAMP CONTROL CIRCUIT HAVING A TEMPERATURE DEPENDENT CAPACITOR

[75] Inventor: Johan F. T. van Heemskerck Veeckens, Eindhoven, Netherlands

[73] Assignee: U.S. Philips Corporation, New York, N.Y.

[21] Appl. No.: 833,152

[22] Filed: Sep. 14, 1977

[30] Foreign Application Priority Data

Sep. 21, 1976 [NL] Netherlands ..... 7610451

[51] Int. Cl.[2] ..... H01J 7/44; H01J 17/34

[52] U.S. Cl. ..... 315/59; 315/53; 315/227 R; 315/241 R; 315/243; 315/DIG. 5; 315/309

[58] Field of Search ..... 361/282; 315/53, 59, 315/62, 227 R, 241 R, 243, 244, 309

[56] References Cited

U.S. PATENT DOCUMENTS 4,010,398 3/1977 Meuwes ..... 315/101

4,029,989 6/1977 Fellows ..... 315/51

*Primary Examiner*—Alfred E. Smith

*Assistant Examiner*—Charles F. Roberts

*Attorney, Agent, or Firm*—Bernard Franzblau; David R. Treacy

[57] ABSTRACT

An improved control circuit for an electric discharge lamp includes a temperature-dependent capacitor connected in series or in parallel with the discharge lamp. The capacitor preferably has a negative temperature characteristic and is responsive to the heat generated in the discharge lamp. During the start-up period, the lamp temperature is low and the capacitance is relatively high, whereas in the operating condition of the lamp its temperature increases and the capacitance of the capacitor drops to a relatively low value. In the series arrangement, the starting current of the lamp is thereby increased over the operating current to promote better ignition of the lamp. Similarly, in the parallel arrangement the high capacitance capacitor facilitates lamp ignition, whereas during normal lamp operation the low capacitance shunt branch effectively appears as an open circuit exerting minimal influence on the lamp operation.

6 Claims, 4 Drawing Figures

ELECTRIC DISCHARGE LAMP CONTROL CIRCUIT HAVING A TEMPERATURE DEPENDENT CAPACITOR

BACKGROUND OF THE INVENTION

This invention relates to a discharge lamp adapted for operation by an alternating current. More particularly, the invention relates to a control circuit which optimizes the start-up and normal operation of the discharge lamp with a minimum number of circuit components.

A prior art discharge lamp circuit using a voltage multiplier control circuit is disclosed in U.S. Pat. No. 4,010,398. A disadvantage of this known lamp control circuit is that it uses a capacitor having a fixed value so that at the beginning of the starting procedure — when the lamp temperature is still substantially equal to the ambient temperature — the lamp control circuit has the same properties as when the lamp is in operation. This means that the lamp control circuit does not have the optimum capacitance value for all circumstances.

Another prior art discharge lamp control circuit is described in U.S. Pat. No. 3,996,495 wherein a voltage and/or current dependent capacitor is connected in circuit so as to improve the crest factor of the lamp current waveform and hence the operating efficiency of the system. U.S. Pat. No. 4,029,989 describes a discharge lamp having a separate starting electrode to which a voltage doubler circuit is connected which includes a temperature-dependent capacitor. Neither of these systems automatically provides optimum operation of the discharge lamp in both the start-up period and during normal lamp operation subsequent to the ignition thereof.

It is an object of the invention to provide a control circuit for a discharge lamp wherein the capacitor has a suitable capacitance value in the various conditions of the lamp.

A further object of the invention is to provide a discharge lamp control circuit operable from a source of AC current and including a temperature-dependent capacitor that automatically varies its capacitance value as a function of the condition of the lamp so as to provide optimum values of capacitance for all conditions of the lamp.

SUMMARY OF THE INVENTION

In a first group of discharge lamps according to the invention, adapted for operation with alternating current, the lamp is provided with two input terminals and with a discharge tube which comprises at least two main electrodes. The discharge tube is enveloped by an outer bulb and a capacitor associated with the lamp is electrically connected to at least one of the lamp main electrodes. The capacitor has a negative temperature coefficient and the input terminals are interconnected by means of a series circuit including at least the capacitor and the discharge path between the main electrodes of the discharge tube.

In a second group of discharge lamps according to the invention, also adapted for operation with alternating current, the lamp is provided with two input terminals and with a discharge tube which comprises at least two main electrodes. The lamp is enveloped by an outer bulb and a capacitor associated with the lamp is electrically connected to at least one of the main electrodes. The capacitor has a negative temperature coefficient and is included in a branch circuit which, for both current directions, is in parallel with the discharge path between the main electrodes of the discharge tube.

An advantage of the two groups of discharge lamps according to the invention is that the capacitor can have, during both the starting procedure and also the operating condition of the lamp, a capacitance value which is automatically matched to the different operating conditions of the lamp.

To further elucidate, with a discharge lamp of the first group the capacitor acts as a stabilization ballast for the discharge tube. In the cold state of the discharge tube, i.e. at the beginning of the starting procedure, the capacitor has a relatively large capacitance. This means that its impedance is small. For lamps which have no other stabilization ballast besides this capacitor, as well as for those discharge lamps which have an additional ballast, e.g. an inductive ballast in series therewith, it follows that a small impedance value of the capacitor implies a fairly high starting current for the lamp. This means that the lamp can quickly arrive at its operating condition. Once the lamp is in the operating condition, then the capacitor, which is thermally coupled to the lamp, will assume a higher temperature. This results in a decrease in its capacitance so that its impedance increases. As a result the lamp current will then be lower than the starting current.

If the capacitor of the stabilization ballast had been of the type having a fixed capacitance value, it would not have been able to provide the advantage of an accelerated starting of the discharge lamp.

In the case of a discharge lamp according to the invention of the second group, the capacitor and the discharge path between the main electrodes of the discharge tube are connected in parallel branches. Here the capacitor is adapted to promote starting of the lamp. This capacitor may also serve to improve the power factor (cos $\phi$)of the control circuit in which the discharge lamp will be included.

It should be noted that it has previously been proposed to connect a capacitor associated with the lamp in parallel with the discharge path between the main electrodes of the discharge tube. In that case, however, the capacitor had a fixed capacitance.

In a discharge lamp according to the invention of the second group, the parallel capacitor has a negative temperature coefficient. An advantage thereof is that the capacitance value is high during the starting procedure and is low when the lamp is in its operating condition. This may mean an easy start and without the usual disadvantages of a parallel capacitor during operation of the lamp because the high impedance of the parallel capacitor effectively appears as an open circuit to the lamp.

The capacitance value of the capacitor changes, for example, by a factor of 10 for a change in temperature of 175° C.

A lamp according to the invention may, for example, be a high-pressure discharge lamp or a low-pressure discharge lamp.

BRIEF DESCRIPTION OF THE DRAWING

The invention will now be further explained with reference to the accompanying drawing, in which:

FIG. 1 shows a high-pressure mercury vapor discharge lamp provided with a discharge vessel 1 which also comprises iodides. The discharge vessel is made of quartz glass. Tungsten electrodes 2 and 3 are disposed at the ends of the tube 1. The electrodes 2 and 3 are supported by current leads 4 and 5 respectively, which are passed, by means of molybdenum foils 6 and 7 respectively, in a vacuum-tight manner through the pinched feet 8 and 9 respectively. Tube 1 is suspended in a glass outer bulb 10 by means of metal strips 11 and 12 respectively, which clamp around the pinched feet 8 and 9 respectively, and are connected to the supporting electrodes 13 and 14 respectively, which also serve as current supply elements for the electrodes 2 and 3 respectively. The current supply elements 13 and 14 are led out in a vacuum-tight manner through the outer bulb 10. Current supply element 14 is connected to a temperature-dependent capacitor 15 mounted in a base 16 of the lamp This capacitor has a negative temperature coefficient. The dielectric thereof may be, for example, a barium titanate. The other end of the capacitor 15 is connected to a connecting contact (input terminal) 17 on the lamp base. Current supply element 13 is connected directly to another connecting contact (other input terminal) 18 of the lamp base 16.

In FIG. 2 reference numeral 1 is the discharge tube of FIG. 1, reference numeral 15 indicates the temperature-dependent capacitor and the lamp input terminals have the numerals 17 and 18 respectively. The terminal 17 is connected to a power supply terminal 20 through an inductive stabilization ballast 19. The terminal 18 is connected to a power supply terminal 21. The voltage applied between the terminals 20 and 21 may be, for example, approximately 220 Volts, 2500 Hertz.

Figure 1:
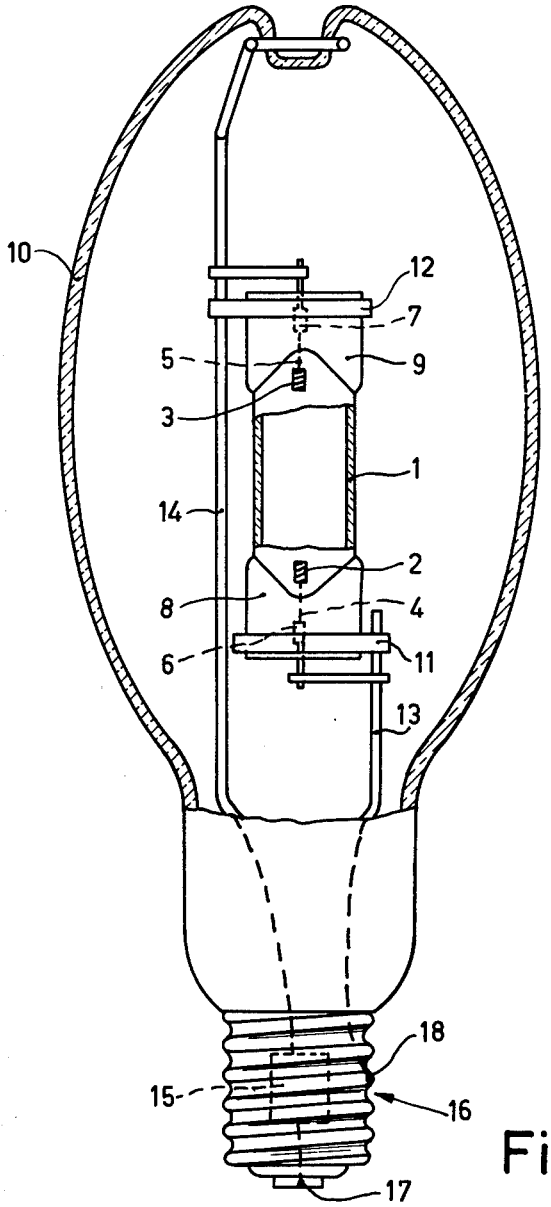
FIG. 1 shows a longitudinal section, partly elevational view, of a discharge lamp according to the invention.

When the specified voltage is applied between the terminals 20 and 21, the capacitor 15, on starting of the tube 1, will at first exhibit a high capacitance, that is to say a low impedance. The electric current through the tube 1 will then be relatively high. As a result the tube will rapidly arrive at its operating condition. Once this has happened, the generation of heat in this tube will heat the capacitor 15 located in the lamp base 16 so that its capacitance value decreases. Consequently, a reduced current then flows through the discharge tube 1.

In a practical embodiment of the invention the power of the lamp was approximately 400 Watts and the self-induction of the stabilization component 19 was approximately 3 mHenry. The capacitance value of the capacitor 15, at room temperature (25° C.), was approximately one microFarad and in the operating condition of the lamp, that is to say at approximately 150 degrees centigrade, its capacitance was 0.6 microFarad. The starting current through the tube 1 was then approximately 8 amps and in the operating condition approximately 3 amps.

Figure 3:
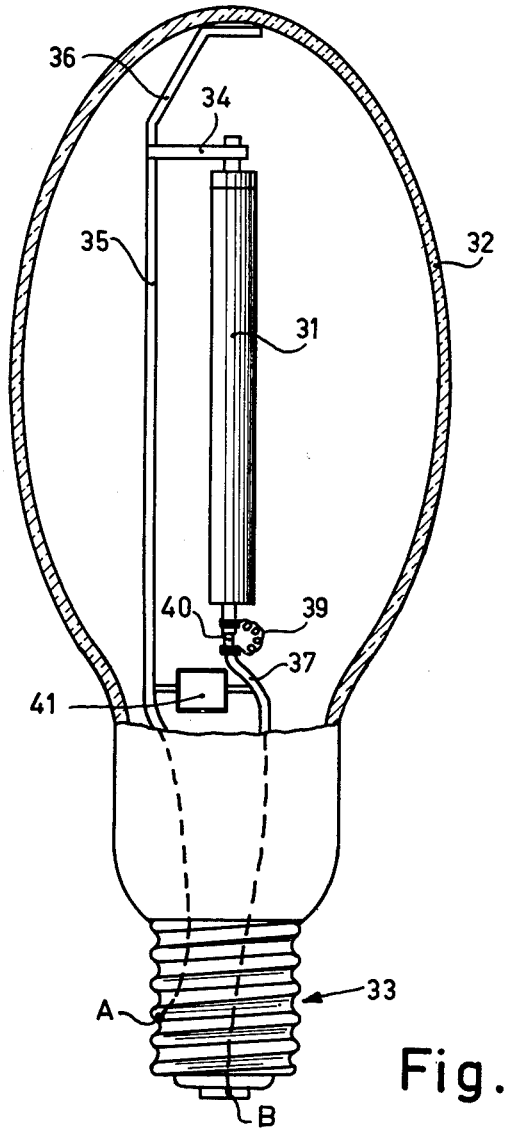
FIG. 3 shows a longitudinal section, partly elevated view, of a second discharge lamp according to the invention.

FIG. 3 shows a high-pressure sodium vapor discharge lamp. Reference numeral 31 represents a discharge tube which is enveloped by an outer bulb 32. Reference numeral 33 indicates a base of that lamp. The power of the lamp is approximately 400 Watts.

The end of the tube 31 which faces away from the base 33 is connected to a supply strip 34. In turn the strip 34 is connected to an electric supply conductor 35. An extension 36 of the supply conductor 35 serves to support and center the discharge tube 31 in the outer bulb 32. Furthermore, the supply conductor 35 is connected to the cylindrical portion A of the outer circumference of the lamp base 33.

The end of the discharge tube 31 which faces the base 33 is connected to an electric supply conductor 37 which in turn leads to a center contact B of the base 33. An electric connection 39 serves to supply current to the tube 31. A section 40, in the extension of the conductor 37, has a supporting function only, namely to provide a flexible support for the tube 31.

Reference numeral 41 represents a temperature-dependent capacitor mounted in the outer bulb 32. This capacitor has a negative temperature coefficient. Capacitor 41 is connected between the conductors 35 and 37 and in this manner constitutes a shunt circuit across the discharge path of the discharge tube.

The discharge tube 31 (see FIG. 4) is provided with a first internal main electrode 43 and a further main electrode 44. The electrode 43 is connected to the lamp input terminal A which in turn is connected to a power supply terminal 46 through a stabilization impedance coil 45. The internal electrode 44 is connected to the lamp input terminal B. This terminal B is connected to a power supply terminal 47. Reference numeral 41 again indicates the shunt capacitor.

The circuit of FIG. 4 operates as follows. First a voltage is applied between the terminals 46 and 47, for example, 220 Volts, 50 Hertz. Then the capacitor 41 is, in the first instance, also at ambient temperature and consequently has a high capacitance value. The discharge tube 31 starts, which is promoted by the presence of the capacitor 41. Owing to the subsequent generation of heat in the discharge tube, capacitor 41 will be heated too. As a consequence the capacitance value of this capacitor decreases so that it is virtually placed outside the circuit. In other words, with a low capacitance value the capacitor has such a high impedance that it effectively appears as an open circuit and therefore has very little effect on the normal lamp operation.

Figure 4:
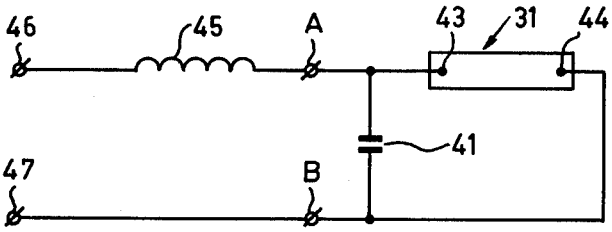
FIG. 4 shows a control circuit for the second lamp according to the invention including a stabilization coil and other connections of a power supply circuit for the second lamp.

In a practical embodiment of the control circuit of FIG. 4, the stabilization element 45 has a self-induction of approximately 0.15 Henry. The capacitor 41 has, at room temperature (25° C.), a capacitance of approximately one microFarad and in the operating condition of the lamp, that is to say at a temperature of approximately 200° C., a capacitance of approximately 0.1 microFarad. This low capacitance value hardly affects the behavior of the lamp in its operating condition.

Figure 2:
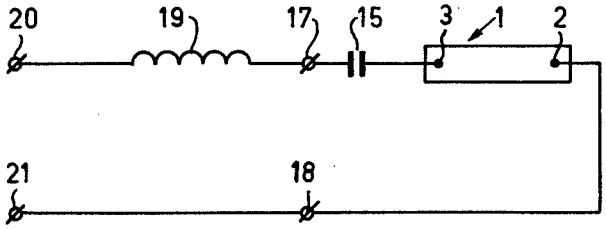
FIG. 2 shows the control circuit for the lamp of FIG. 1 including a stabilization coil and further connecting wires of a power supply circuit for the lamp.

In the last example (FIGS. 3 and 4) the change in capacitance of the capacitor is slightly greater than in the example which was described first (FIGS. 1 and 2). The reason for this is that in the example which was described last the capacitor is positioned nearer to the discharge tube than in the example first described.

In the two described embodiments the capacitor has, in the operating condition of the lamp, a lower capacitance than during start-up of the lamp Therefore, it was possible for a single capacitor to provide, in both the one situation (starting condition) and the other situation (operating condition) of the lamp, a suitable capacitance value.

A lamp according to the invention may, for example, also be a low-pressure sodium discharge lamp.

It is also conceivable that the temperature-dependent capacitor may be used in combination with a capacitor having a fixed capacitance value.

What I claim is:

1. Apparatus for operating an electric discharge lamp with alternating current comprising, a pair of input terminals for connection to a source of AC current, said lamp including a discharge tube having at least two main electrodes defining a discharge path and an outer bulb which envelops the discharge tube, a capacitor having a negative temperature coefficient electrically connected to at least one main electrode of the discharge tube and located in heat responsive relationship to the discharge tube, and means connecting said capacitor and the discharge path between the discharge tube main electrodes in series circuit across said pair of input terminals.

2. Apparatus as claimed in claim 1 wherein said capacitor is positioned within said outer bulb.

3. Apparatus as claimed in claim 1 further comprising an inductor connected in series with the capacitor and the discharge tube main electrodes across the pair of input terminals.

4. Apparatus for operating an electric discharge lamp with alternating current comprising, a pair of input terminals for connection to a source of AC current, said lamp including a discharge tube having at least two main electrodes defining a discharge path and an outer bulb which envelops the discharge tube, a capacitor having a negative temperature coefficient electrically connected to at least one main electrode of the discharge tube and located in heat responsive relationship to the discharge tube, and means connecting said capacitor in a branch circuit which, for both directions of current flow, is in parallel with the discharge path between the main electrodes of the discharge tube.

5. Apparatus as claimed in claim 4 wherein said capacitor is positioned within said outer bulb.

6. Apparatus as claimed in claim 4 further comprising an inductor connected in series with the discharge tube main electrodes across the pair of input terminals.

* * * * *